United States Patent [19]

Klaschka et al.

[11] 4,353,415

[45] Oct. 12, 1982

[54] HEAT PIPES AND THERMAL SIPHONS

[75] Inventors: John T. Klaschka, Fleet; Michael J. Davies, Wantage, both of England

[73] Assignee: United Kingdom Atomic Energy Authority, London, England

[21] Appl. No.: 171,791

[22] Filed: Jul. 24, 1980

[30] Foreign Application Priority Data

Jul. 30, 1979 [GB] United Kingdom ..... 7926436

[51] Int. Cl.[3] ..... F23D 15/00

[52] U.S. Cl. ..... 165/104.21; 165/104.14; 165/133; 165/54; 29/157.3 H

[58] Field of Search ..... 165/104.26, 133, 104.21, 165/104.14, 54, 110; 29/157.3 H

[56] References Cited

U.S. PATENT DOCUMENTS

| | | | |
|---|---|---|---|
| 3,528,494 | 9/1970 | Levedahl | 165/104.26 |
| 3,762,468 | 10/1973 | Newson et al. | 165/110 |
| 3,807,493 | 4/1974 | Stewart | 165/104.26 |
| 4,090,555 | 5/1978 | Anderson et al. | 165/104.21 X |
| 4,116,266 | 9/1978 | Sawata et al. . | |
| 4,226,282 | 10/1980 | Kunsagi et al. . | |

FOREIGN PATENT DOCUMENTS

| | | | |
|---|---|---|---|
| 1451137 | 3/1969 | Fed. Rep. of Germany | 165/110 |
| 54-47159 | 4/1979 | Japan | 165/104.26 |
| 1118468 | 7/1968 | United Kingdom . | |
| 1125485 | 8/1968 | United Kingdom . | |
| 1275946 | 6/1972 | United Kingdom . | |
| 1433541 | 4/1976 | United Kingdom . | |
| 1499578 | 2/1978 | United Kingdom . | |
| 2025603 | 1/1980 | United Kingdom . | |

*Primary Examiner*—Albert W. Davis, Jr.
*Attorney, Agent, or Firm*—Larson and Taylor

[57] ABSTRACT

A heat pipe or thermal siphon having an internal surface shaped to promote thin film evaporation therefrom. The internal surface consists of a number of equi-spaced longitudinally extending ribs which define grooves between them, and the ribs may be of rectangular, semicircular, or triangular form. In use the bulk of the condensate in the thermal siphon is pulled by surface tension effects into the corners of the grooves, and leaves a thin film of the condensate between the rivulets. An assembly of heat transfer fins is attached externally one at each side of the heat pipe or thermal siphon for air flow therethrough transverse to the length of the heat pipe or thermal siphon, and a number of such assemblies are clustered together with a silicone rubber sealing strip between them at about the center of each assembly to divide the cluster into two sealingly separated portions.

12 Claims, 14 Drawing Figures

Fig. 2.
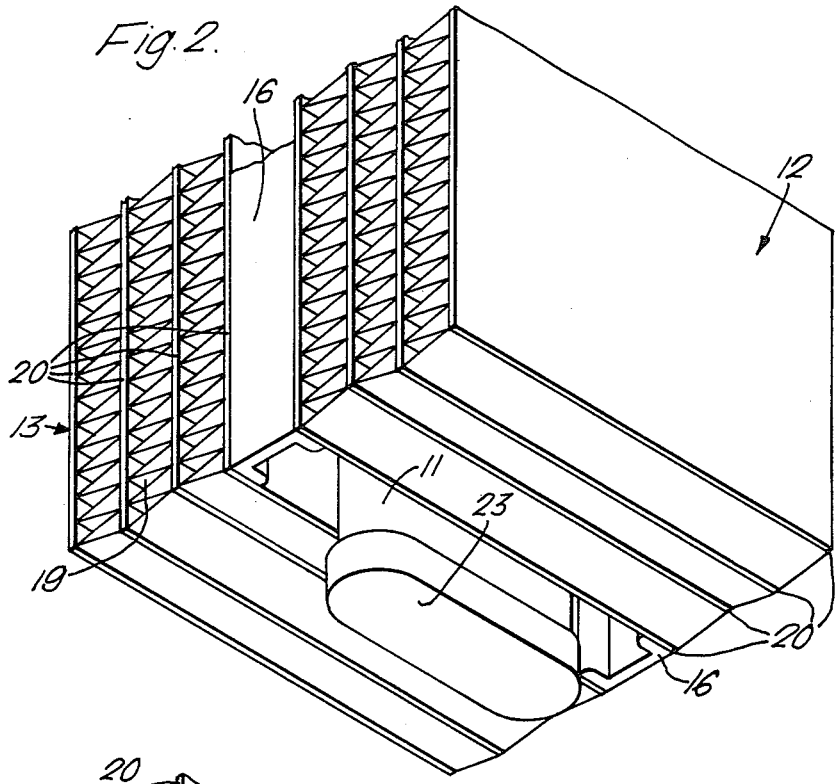
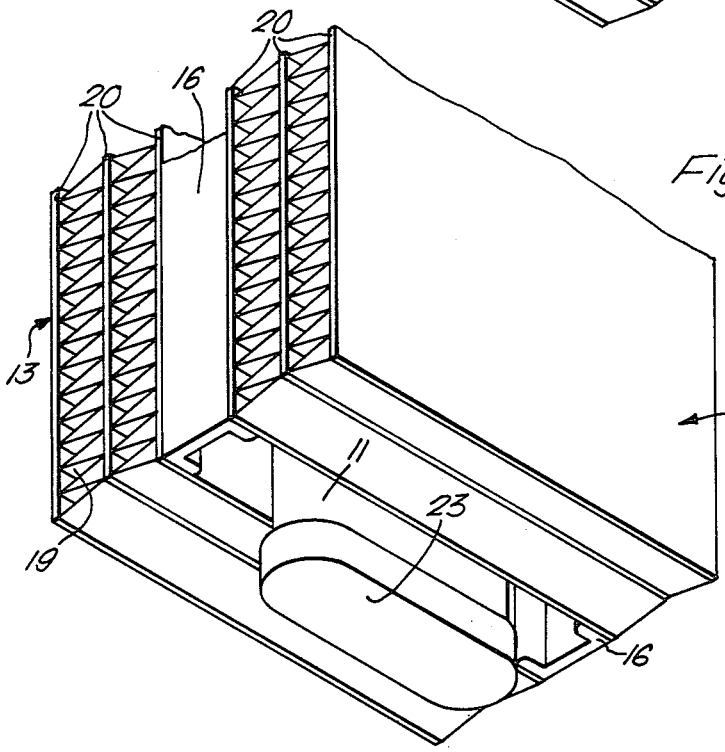
Fig. 2a.

HEAT PIPES AND THERMAL SIPHONS

This invention relates to heat pipes and thermal siphons and more particularly but not exclusively to those used in the recovery of waste heat.

Thermal siphons are related to heat pipes and are described in "Heat Pipes" 2nd Edition, by P. D. Dunn and D. A. Reay, published 1978 by Pergamon Press, Oxford, England, and New York, USA, and reference is directed to this publication for detailed information. Briefly, thermal siphons are devices for the conductance of heat in a substantially vertical direction by the effect of the vaporisation and subsequent condensation of a liquid in a substantially vertically aligned tube, boiling of the liquid taking place at the bottom of the tube, and condensation occurring at the upper end of the tube from which the condensate is returned to the lower end of the thermal siphon by gravitational force. In the case of a heat pipe, the condensate is returned by capillary forces which may be provided by capillary grooves or a wick so that a heat pipe may be used to conduct heat in a variety of directions.

According to the present invention, there is provided a heat conductance device comprising a heat pipe or a thermal siphon having at least a portion of the internal surface thereof shaped so as to promote thin film evaporation therefrom. The shaped internal surface may also be arranged to promote thin film condensation thereon.

The shaped internal surface may comprise a plurality of grooves extending in a direction along the length of the device.

Desirably, the grooves are defined between ribs which may be of triangular, semi-circular, or rectangular cross-section, or be defined by ribs having parallel sides and rounded tips.

Preferably, the device is shaped to provide two flat longitudinally extending external portions in parallel relationship.

A heat exchange module may be provided by a plurality of heat exchange surfaces defining a plurality of passageways in parallel relationship and joined thermally conductively to the thermal device, the passageways being arranged for air flow therethrough transverse to the direction of the length of the thermal device. The thermal device is desirably sandwiched between the heat exchange surfaces.

The invention also includes a heat exchange assembly comprising a plurality of said modules clustered together with the thermal devices thereof in parallel relationship, adjacent modules having therearound an elastomeric sealing strip so as to divide said modules and thereby the assembly into two sealingly separated portions for heat exchange between the portions through the thermal devices thereof.

The vast majority, if not all literature on heat pipes discusses boiling in the hot part of the pipe and condensation in the cold part. Where the term "evaporation" is used, the term is synonymous with boiling and is not used in its true context. Boiling is a process where the heat flux through the wall and across the liquid film on the inside of the wall is sufficient to cause a temperature difference large enough to promote nucleation and vapour formation at the wall and within the liquid. Evaporation is a process where the heat flux can be transmitted by conduction through the liquid film, with evaporation occurring at the surface of the film.

In waste heat recovery, the limiting factor is the temperature difference between hot and cold gas streams and this is often as small as 30° C. In order to accomplish waste heat recovery, heat has to be transferred from the hot gas, for example to a fin surface of a heat exchanger, from the fin surface by conduction to the heat pipe wall and through the heat pipe wall, from the heat pipe wall across the boiling process into the internal vapour space in the heat pipe, up the heat pipe by vapour flow, across the condensing film in the cold end of the heat pipe, by conduction through the heat pipe wall to the fins of the heat exchanger in the cold gas stream, and then into the cold gas stream itself. The majority of the resistance to heat transfer is between the fins and the gas streams. Thus for an economic heat exchanger it is necessary that the temperature differences associated with transfer within the heat pipe should be very small indeed.

At the lower temperature ranges (30°/50° C.) the superheat necessary to initiate boiling is of the order of 10° to 30° C. which is equivalent to the majority of the driving force available for heat transfer from the hot to the cold gas streams, with the consequence that the boiling process is unlikely to start, or if it does start the heat transfer coefficient will be low.

The invention overcomes these difficulties by the use of a heat pipe or a thermal siphon in which the condensation process is a Nusselt thin film process, and the hot end of the heat pipe or thermal siphon is designed to provide a true evaporation process. In a true evaporation process the heat transfer coefficient is inversely proportional to the film thickness and is not related to available temperature differences except indirectly by hydrodynamics. Thus in the preferred thermal siphon of the invention, thin film processes are used for evaporation and for condensation, the shaped internal surfaces of the preferred thermal siphon resulting in a small proportion of the internal surface being used to encourage rivulet flow of the bulk of the condensate so as to leave a major proportion of the internal surface covered by a thin film of the condensate with consequently an improved heat transfer coefficient.

The shaped internal surface of a thermal siphon of the invention is in complete contrast to the capillary grooves of a conventional heat pipe, since the heat pipe's capillary grooves provide return flow of the condensate under the effect of surface tension acting in the direction of flow whereas surface tension effects transverse to the direction of flow are used in the invention to pull the condensate into rivulets to leave a thin film of condensate therebetween.

The invention will now be further described with reference to the accompanying drawings in which:

FIG. 1 shows a perspective view of a thermal siphon module;

FIG. 1*a* shows a perspective view of an alternative thermal siphon module to that shown in FIG. 1;

FIG. 2 shows a fragmentary perspective view in the direction of arrow 'A' of FIG. 1;

FIG. 2*a* shows a fragmentary view in the direction of arrow 'A' of FIG. 1*a;*

FIG. 3 shows a fragmentary sectional view to an enlarged scale on the line III—III of FIG. 1;

FIGS. 3*a* to 3*d* show fragmentary sectional views of modified portions of the view of FIG. 3;

FIG. 3*e* shows a modification of the view of FIG. 3;

In the above Figures like parts have like numerals.

Figure 1:
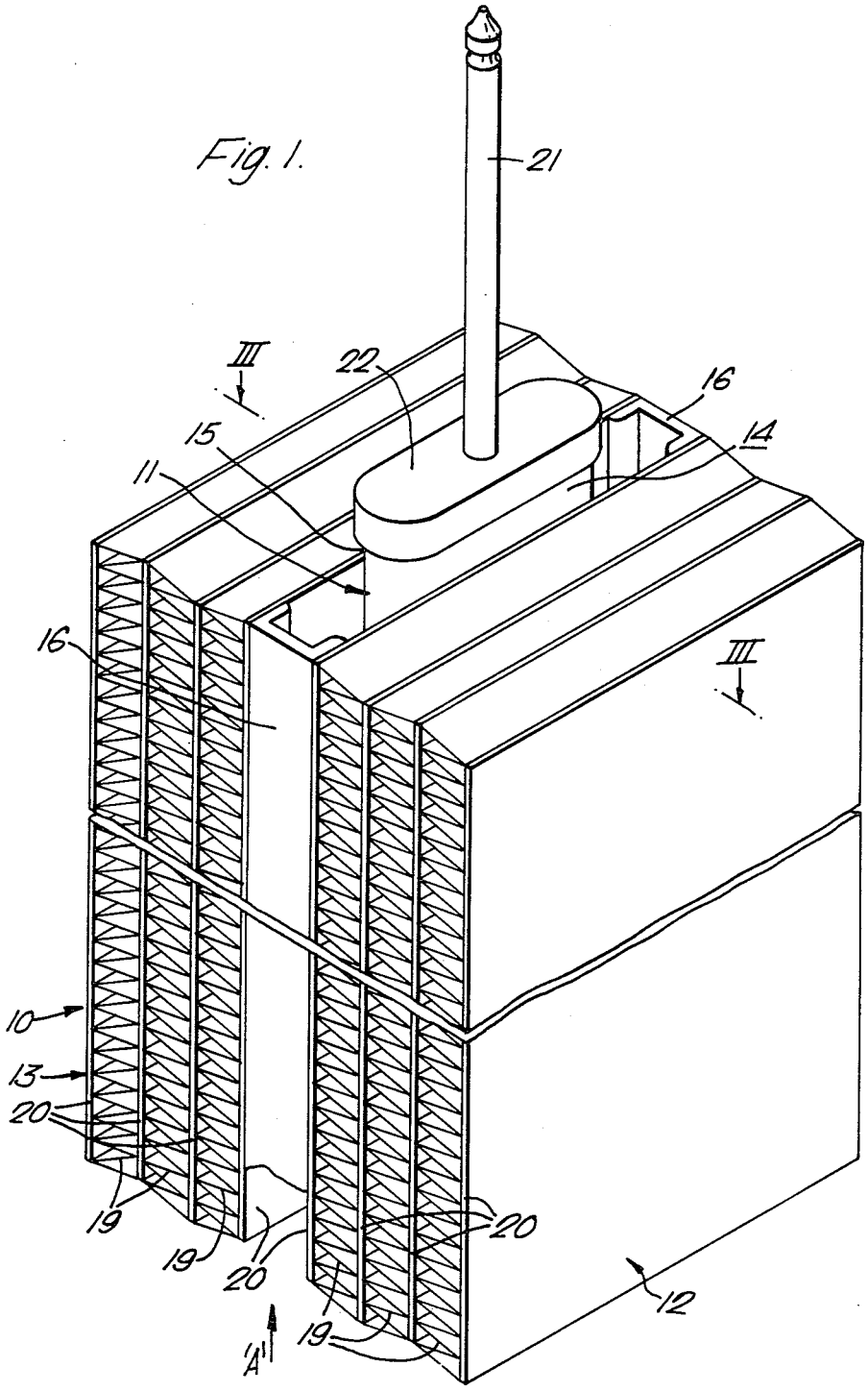

Referring now to FIG. 1 and FIG. 2, a thermal siphon module 10 is shown and comprises a thermal siphon 11, and heat exchange elements 12 and 13 each soldered to a respective one of parallel flat walls 14 or 15 of the thermal siphon 11, the space between the heat exchange elements 12, 13 at the outer surfaces thereof being closed at each side of the thermal siphon 11 by a respective channel member 16 having its outer surface flush with that of the heat exchange elements 12, 13. Each heat exchange element 12, 13 is provided by three layers of copper fins 19 of pleated form extending between copper side plates 20 and arranged so as to lie and allow air flow therethrough in a direction normal to the length of the thermal siphon 11. A filling tube 21 for a liquid (not shown) extends from an upper end cap 22 of the thermal siphon 11, whilst a lower end cap 23 closes the lower end of the thermal siphon 11.

Figure 3:
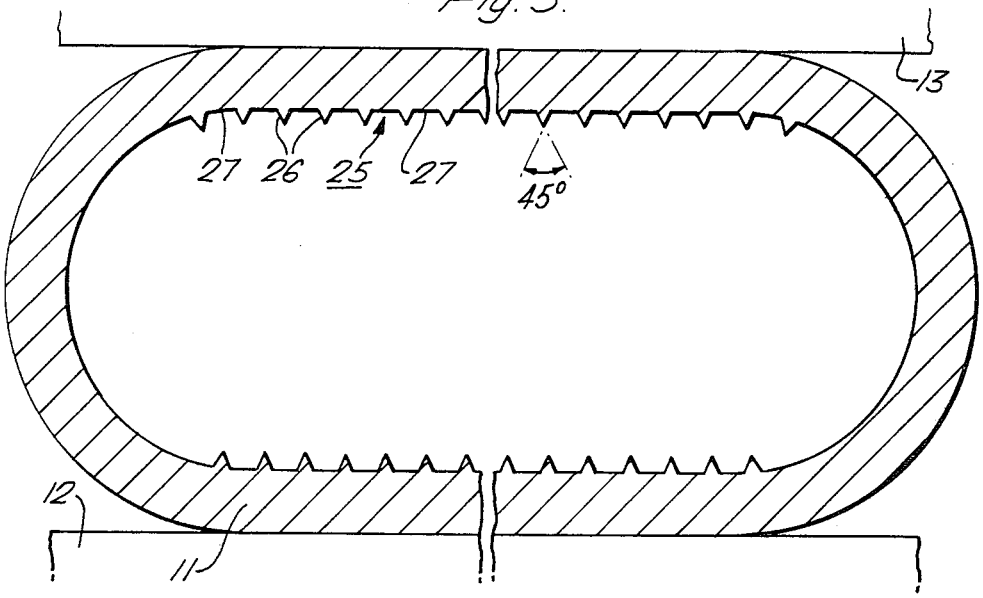

Referring now to FIG. 3, the internal surface of the thermal siphon 11 is shaped to provide along the flat walls 14, 15 thereof a plurality of longitudinally extending grooves 25 defined by a parallel array of ribs 26 of triangular cross-section each having an apex included angle of about 45° and defining a land 27 between adjacent ribs 26.

Figure 4:
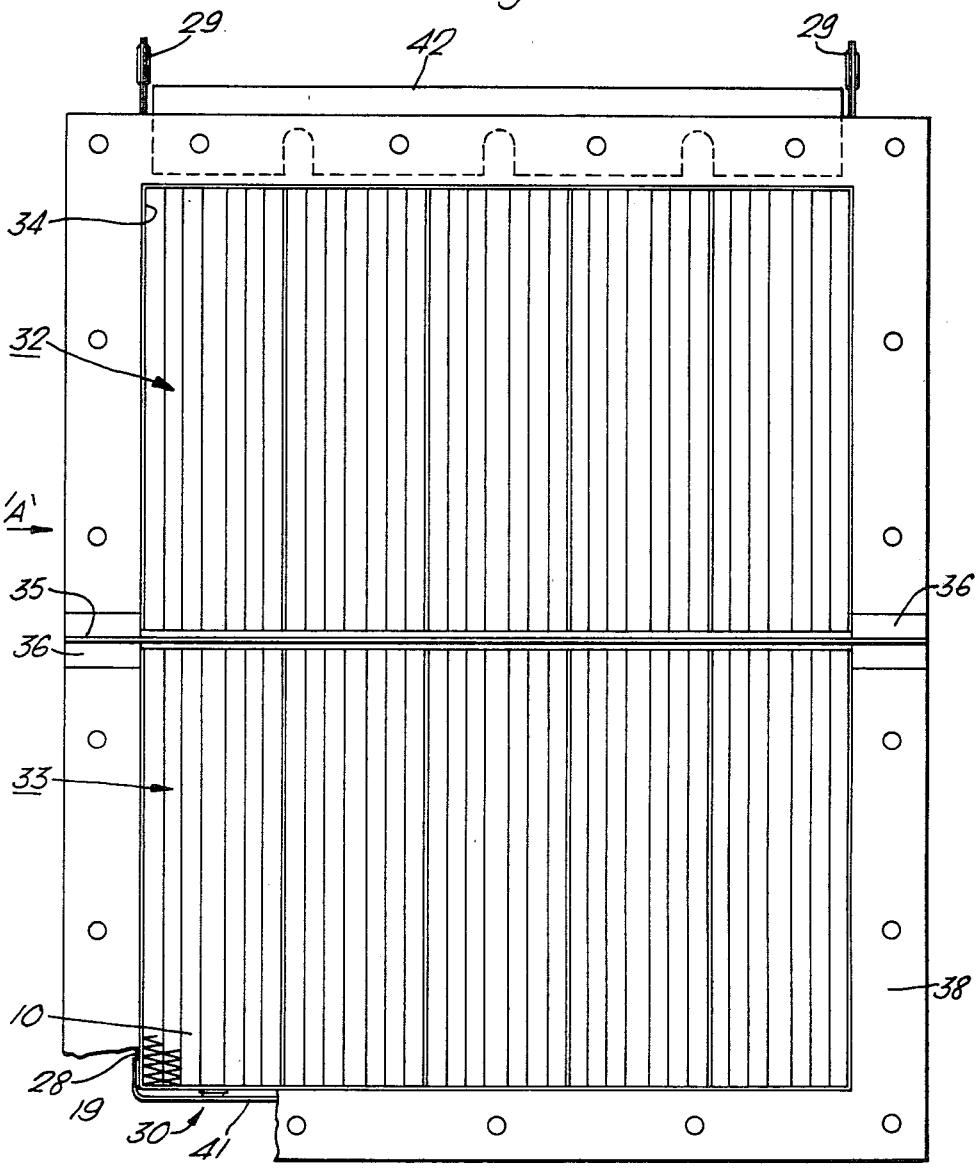
FIG. 4 shows in plan a heat exchange assembly incorporating a number of the thermal siphon modules of FIG. 1.
Figure 5:
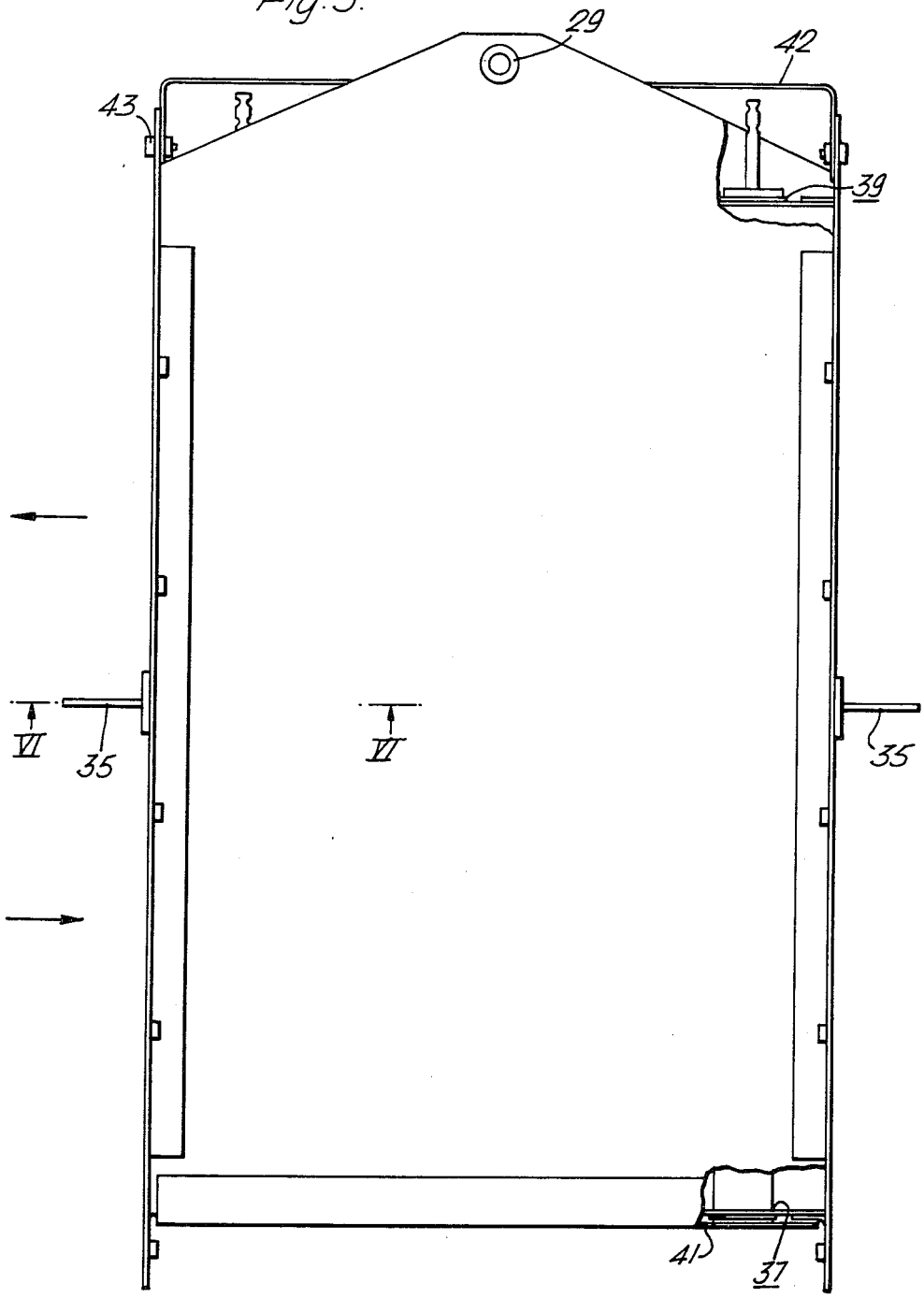
FIG. 5 shows a view in the direction of arrow 'A' of FIG. 4.
Figure 6:
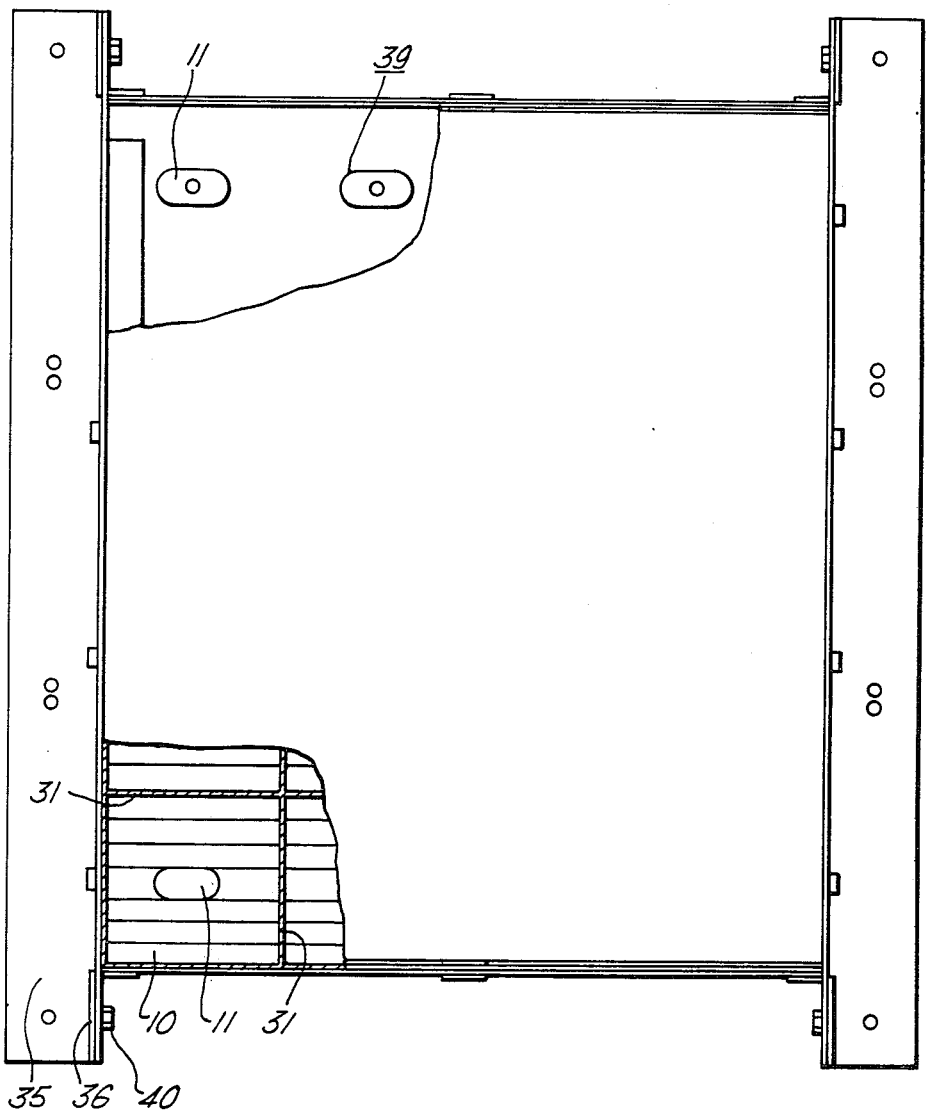
FIG. 6 shows a view in part-section on the line VI—VI of FIG. 5.

A number of modules 10 as shown in FIGS. 4 to 6 to which reference is made are clustered together within a metal casing 28 with the thermal siphons 11 thereof upright to form a heat exchange assembly 30. The casing 28 defines a square-shaped duct 34 and has a central ledge 35 at each end thereof, the respective ledge 35 being welded at each end to a support plate 36 which is secured to a flange 38 of the casing 29 by screws (not shown). Each module 10 has around the centre thereof a strip 31 of an adhesive rubber sealant, such as Dow Corning "SILASTIC" 732 RTV silicone rubber, so as to bear against adjacent modules 10 and against the inside of the casing 28 and the ledges 35, thus dividing the modules 10 in the duct 34 into an upper portion 32 and a lower portion 33 which are sealingly separated from each other by the sealing strips 31. The thermal siphons 11 of the modules 10 locate at the lower ends thereof in respective apertures 37 in the base of the duct 34 and protrude at the upper ends thereof through respective apertures 39 in the roof of the duct 34, the modules 10 being sealingly joined to the casing 28 by "SILASTIC" 732 RTV silicone rubber sealant (not shown). The lower ends of the thermal siphon 11 are protected by a floor 41, and a removable cover 42 secured by bolts 43 to the casing 28 protects the upper ends of the thermal siphons 11. Lifting eyes 29 at each side of the casing 28 facilitate handling of the assembly 30.

In operation with the heat exchange assembly 30 installed in a heat recovery ducting (not shown) for contra-flow waste heat recovery in the direction of the arrows in FIG. 5, warm exhaust gas passes through the lower portion 33 of the duct 34 below the ledge 35 and transfers heat to the pleated fins 19 in the lower portion 33 from which heat is conducted by the thermal siphons 11 to the upper portion 32 of the duct 34 above the ledge 35 where heat is transferred to the pleated fins 19 in the upper portion 32 and thus to the incoming cool air.

In each thermal siphon 11, heat is conducted by the absorption of heat at the lower end of the thermal siphon 11 as the liquid therein evaporates, and by the desorption of heat at the upper end of the thermal siphon 11 as the vapour condenses at the upper end. The bulk of the condensate from the upper end of the thermal siphon 11 is pulled by surface tension effects into the corners of the grooves 25 where the condensate flows in rivulets, thus leaving a thin film of liquid over the lands 27 where the thin film evaporates without nucleate boiling as it flows downwardly through the lower end of the thermal siphon 11.

The ribs 26 of the thermal siphon 11 may be selected to suit a particular application, for example for use with water as the liquid in the thermal siphon 11 ribs 26 may be used of about 0.5 mm height at a pitch of about 1.51 mm so as to define between adjacent ribs 26 a flat land 27 of about 1.1 mm width. Alternatively, the ribs 26 may be at half the pitch and half the height of the above ribs 26.

Figure 1A:
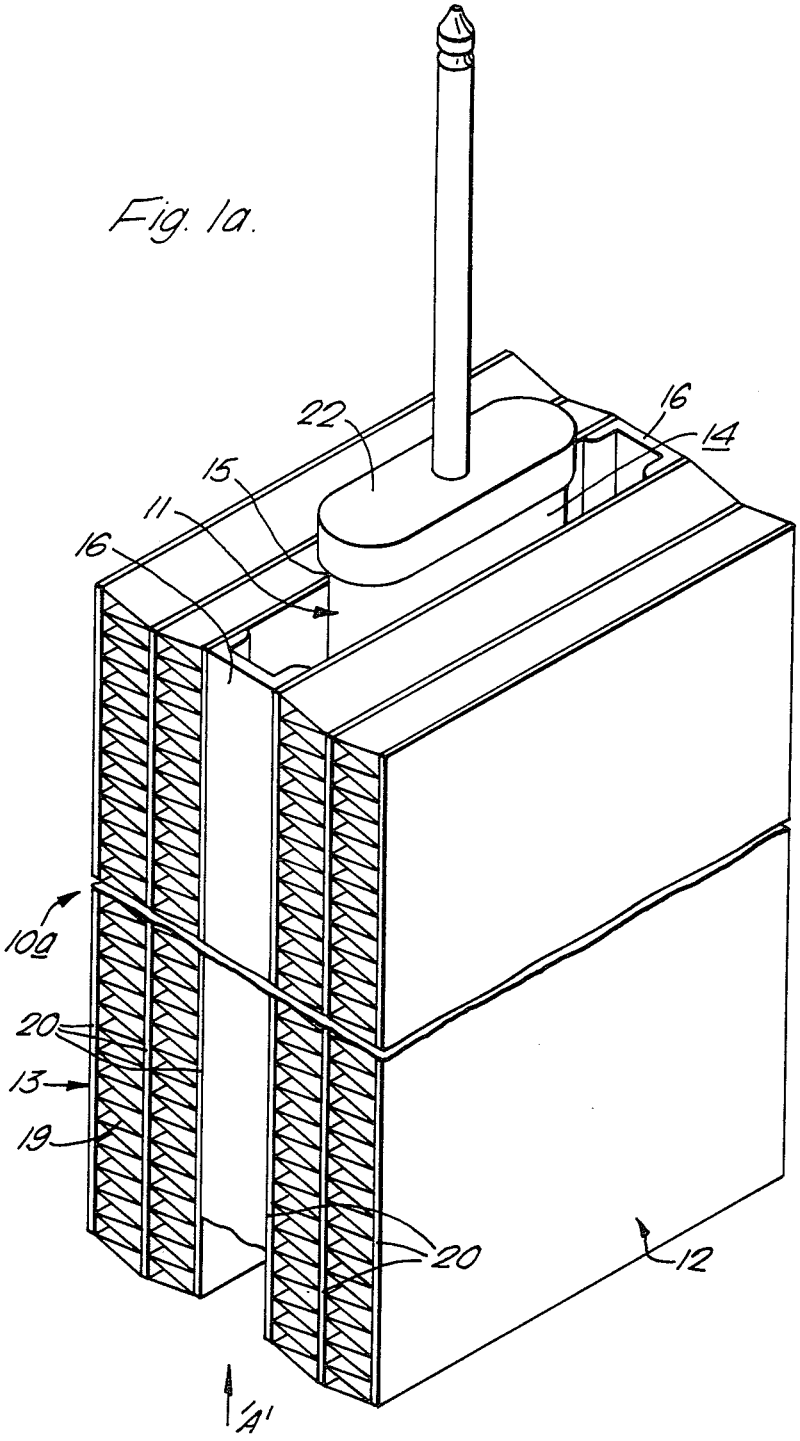

The number of layers of pleated fins 19 used in the heat exchange elements 12, 13 are selected according to the application, for example two layers as shown in the thermal siphon module 10*a* in FIGS. 1*a* and 2*a* to which reference can be made, and the module 10*a* of FIGS. 1*a* and 2*a* may be installed in a heat exchange assembly in a similar manner to that described in relation to FIGS. 4 to 6.

Figure 3A:
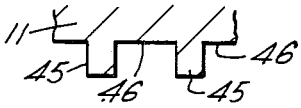
Figure 3B:
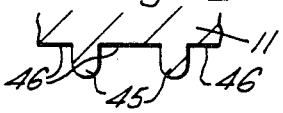

Although triangular-shaped ribs 26 have been aforedescribed other shapes may be used as shown for example in FIGS. 3*a*, 3*b*, 3*c* and 3*d* to which reference is made, each showing a portion of the internal surface of a thermal siphon 11. In FIG. 3*a* rectangular shaped ribs 45 are shown which define lands 46 therebetween, and in one application ribs 45 of about 0.35 mm wide and 0.5 mm high are spaced so as to define lands 46 of about 1.14 mm wide. In order to ease any manufacturing difficulties that might be associated with the provision of the fins 45 of FIG. 3*a*, the tips of the fins 45 may be rounded as shown in FIG. 3*b* to which reference may be made.

Figure 3C:
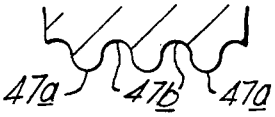
Figure 3D:
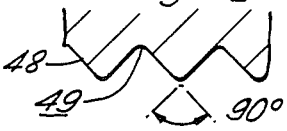

In FIG. 3*c*, semi-circular ribs 45*a* joined together by semi-circular grooves 47*b* are shown, and in one example the ribs 47*a* and the grooves 47*b* might have a radius of about 0.25 mm. In FIG. 3*d* triangular ribs 48 are shown each having an included angle of 90° and a rounded crest, and joined together by a rounded groove 49, the ribs 48 being about 0.5 mm in height, and the groove 49 and the crest of the ribs 48 being about 0.1 to 0.15 mm radius.

Figure 3E:
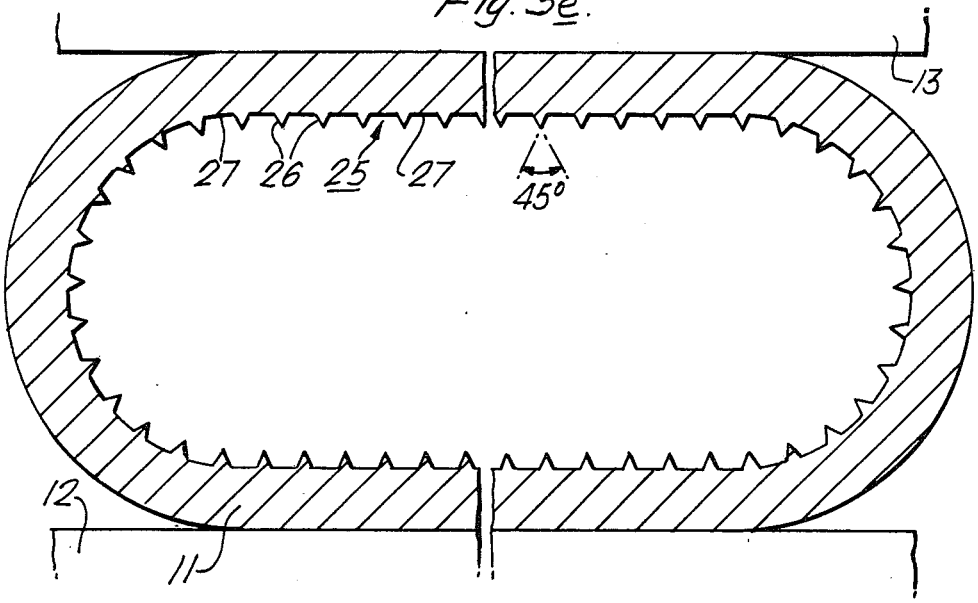

If desired, the ribs may also extend along the curved sides of the thermal siphon 11 as shown in FIG. 3*e*, although the arrangement of FIG. 3 is easier to form and there is no substantial loss of its heat conductance capability in comparison with the thermal siphon 11 of FIG. 3*e*.

Figure 7:
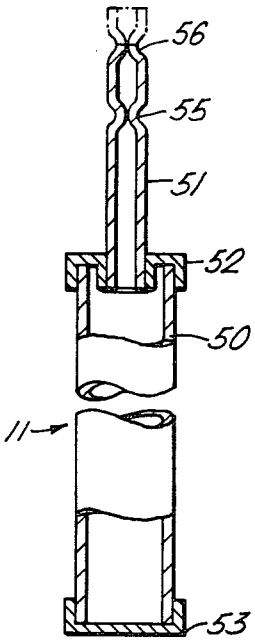
FIG. 7 shows a view in medial section of a thermal siphon.

A thermal siphon 11 according to the invention may be manufactured of copper as follows:

An oval copper tube having a bore slightly larger than that of the required thermal siphon 11 is shaped by a conventional plug-drawing method by being pulled through a die (not shown) or between shaped rollers (not shown), and drawn onto a shaped plug (not shown)

held in the die cavity or between the rollers, the profile of the plug reproducing the required internal surface of the thermal siphon 11 as the tube is drawn onto the plug, for example that shown in FIG. 3*c* or FIG. 3*d*. Referring now to FIG. 7, in the thermal siphon 11 shown a copper tube 50 which has been plug-drawn as aforedescribed to the required external and internal shape of the thermal siphon 11 has its lower end closed by a copper lower end cap 53 and its upper end closed by a copper upper end cap 52 which has a copper tube 51 extending therefrom, both the upper and the lower end caps 52, 53, being hard braxed to the tube 50, and the tube 51 being TIG (Tungsten Inert Gas) edge welded to the upper end cap 52. The tube 50 is then evacuated to a vacuum of about $10^{-3}$ Torr, and triple-distilled and vacuum outgassed water then injected through the tube 51 into the tube 50 to occupy about 10% of the inside volume of the tube 50. A first crimp 55 to form a cold weld is then made in the tube 51 followed by a second cold weld crimp 56, the excess tube 51 (shown by the broken line) being removed at the edge of the second crimp 56 after which the second crimp 56 is sealed by TIG edge welding.

An example of the thermal performance of such a copper thermal siphon 11 is as follows:

| | | |
|---|---|---|
| length | 1 meter | |
| internal grooves | triangular ribs as shown in FIG. 3d | |
| notional internal surface area (ignoring projected surface area of the ribs) | 0.114 square meters | |
| | warm end | cool end |
| temperature of the thermal siphon | 87.09° C. | 79.75° C. |
| temperature of the vapour in the thermal siphon | 81.05° C. | 80.61° C. |
| rate of heat transfer per hour | 2.81kW | |

A heat exchange assembly having forty-eight modules 10, each having a thermal siphon 11 as above one meter long, and in an arrangement twelve modules wide x four modules high, has been tested as follows:

| | |
|---|---|
| Air flow (warm exhaust) | 1.47 kg/sec |
| Air flow (cool supply) | 1.19 kg/sec |
| Temperature | |
| Incoming warm exhaust - 80° C. | (dry bulb)/37° C. (wet bulb) |
| Outgoing warm exhaust - 57° C. | (dry bulb)/33° C. (wet bulb) |
| Incoming cool supply - 22° C. | |
| Outgoing cool supply - 54° C. | |

In order to prevent or at least reduce the rate of accumulation of dust particles on the fins 19 of the modules 10, conventional filters (not shown) may be provided for the incoming warm exhaust and the cool supply air.

Although the invention has been described in relation to a thermal siphon having parallel sides, the invention may be incorporated in a thermal siphon having a different cross-sectional shape, e.g. round, and an alternative arrangement may be used for heat transfer to and from the thermal siphon. Furthermore, several thermal siphons 11 may be incorporated in a single module 10 if desired for a particular application, or the thermal siphon 11 of the invention used in an alternative heat transfer arrangement, or manufactured from an alternative material such as aluminium.

It should be possible to incorporate the invention in a heat pipe having a capillary wick for the return of the condensate, by arranging for the boiler portion thereof to provide thin film evaporation of the condensate.

We claim:

1. A heat conductive device in the form of a thermal siphon comprising, a chamber having an evaporation portion thereof where heat is to be applied to the chamber and a condensation portion thereof where heat is to be extracted from the chamber, and a vaporizable liquid in the chamber, the evaporation portion of the chamber having a surface provided with a plurality of grooves of a shape and dimensions such as to promote thin film evaporation therefrom of condensate of the liquid without effecting capillary flow of the condensate along the grooves.

2. A device as claimed in claim 1, wherein ribs of triangular form define the grooves therebetween.

3. A device as claimed in claim 2, wherein each said rib has a rounded crest, and a rounded trough joins adjacent said ribs.

4. A device as claimed in claim 3, wherein each said rib is about 0.5 mm high, each said crest and each said trough is between 0.1 to 0.15 mm radius, and each said rib has an apex included angle of about 90°.

5. A device as claimed in claim 1, wherein ribs of rectangular form define the grooves therebetween.

6. A modification of the device as claimed in claim 5, wherein each said rib has a rounded tip.

7. A device as claimed in claim 5, wherein each said rib is about 0.35 mm wide and 0.5 mm high, and flat lands of about 1.14 mm wide are defined between adjacent said ribs.

8. A device as claimed in claim 1, wherein ribs of semi-circular form define the grooves therebetween, and a semi-circular trough joins adjacent said ribs.

9. A device as claimed in claim 8, wherein each said rib and each said trough has a radius of about 0.25 mm.

10. A device as claimed in claim 1, wherein a casing defines the chamber, the casing is shaped to provide two external flat portions thereof one each side of the chamber and substantially in parallel relationship, and the grooves extend along the inside of that part of the casing having the flat portions thereon.

11. A heat exchange module comprising at least one heat conductance device as claimed in any one of claims 1 to 10, a plurality of heat exchange surfaces joined thermally conductively to the device and between which surfaces the device is sandwiched, the heat exchange surfaces being shaped to define a plurality of passageways in parallel relationship for fluid flow therethrough in a direction transverse to the direction of heat conductance in the device.

12. A heat exchange assembly comprising a plurality of heat exchange modules as claimed in claim 11 and clustered together with the thermal devices thereof in parallel relationship, a respective elastomeric sealing strip around each said module in a plane parallel to the transverse direction of the passageways so as to divide the said modules into two sealingly separated sections, and a close fitting housing into which housing the modules are disposed, the sealing strips of the modules adjacent to the housing bearing against the housing and sealingly separating the sections in the housing.

* * * * *